United States Patent [19]

Thawani

[11] Patent Number: 4,595,073

[45] Date of Patent: Jun. 17, 1986

[54] PLUG-TYPE MUFFLER SECTION

[75] Inventor: Prakash T. Thawani, Stoughton, Wis.

[73] Assignee: Nelson Industries Inc., Stoughton, Wis.

[21] Appl. No.: 610,129

[22] Filed: May 14, 1984

[51] Int. Cl.[4] ..... F01N 1/08

[52] U.S. Cl. ..... 181/265; 181/267; 181/272; 181/276; 181/281

[58] Field of Search ..... 181/247-253, 181/269, 264, 272, 265, 258, 268, 267, 273, 276, 281

[56] References Cited

U.S. PATENT DOCUMENTS

| | | | |
|---|---|---|---|
| 582,485 | 5/1897 | Reeves et al. | 181/267 |
| 712,791 | 11/1902 | Hedstrom | 181/265 |
| 927,246 | 7/1909 | Jackson | 181/267 |
| 1,045,419 | 11/1912 | Matula | 181/267 |
| 1,128,306 | 2/1915 | Goelzer | 181/267 |
| 1,554,351 | 9/1925 | Jack | 181/267 |
| 1,670,766 | 5/1928 | Gould et al. | 181/267 |
| 1,861,775 | 6/1932 | Aseltine | 181/267 |
| 2,036,138 | 3/1936 | Haas | 181/253 |
| 2,716,463 | 8/1955 | Latulippe | 181/267 |
| 3,154,388 | 10/1964 | Purse | 181/276 X |
| 3,354,986 | 11/1967 | Moss et al. | 181/269 |
| 4,056,934 | 11/1977 | Mizusawa et al. | 181/265 X |

FOREIGN PATENT DOCUMENTS

| | | | |
|---|---|---|---|
| 10047 | of 1892 | United Kingdom | 181/264 |
| 220808 | 8/1924 | United Kingdom | 181/269 |

OTHER PUBLICATIONS

Technical Paper Series, Society of Automotive Engineers "An Analytical Model for Exhaust System Design", Eriksson, Apr. 10-12, 1978.

American Society of Mechanical Engineers, "Computer-Aided Analysis of Exhaust Mufflers", Thawani, 82-WA/NCA-10.

*Primary Examiner*—Benjamin R. Fuller

*Attorney, Agent, or Firm*—Andrus, Sceales, Starke & Sawall

[57] ABSTRACT

A plug section for a muffler, including an outer body and having an inlet pipe for introducing exhaust gas into the body. The inner end of the inlet pipe located within the body portion is closed off. Surrounding the inlet pipe is a conical baffle having a small diameter end secured to the inlet pipe to provide a tapered chamber between the inlet pipe and the conical baffle, while the space between the conical baffle and the outer body defines an outer chamber. Both the inlet pipe and the conical baffle are provided with a plurality of perforations. Exhaust gas entering the inlet pipe flows outwardly through the perforations in the inlet pipe to the tapered inner chamber and then flows through the perforations in the conical baffle to the outer chamber. The use of the perforated conical baffle provides a substantial improvement in sound attenuation, reducing both the shell noise level and the outlet noise level.

9 Claims, 5 Drawing Figures

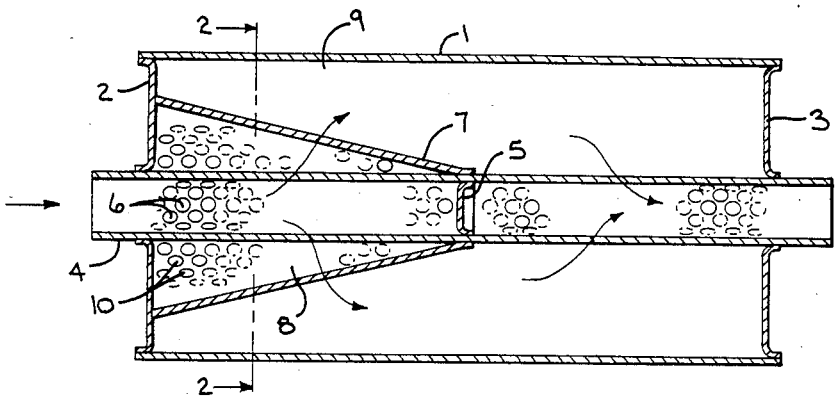
FIG. 1
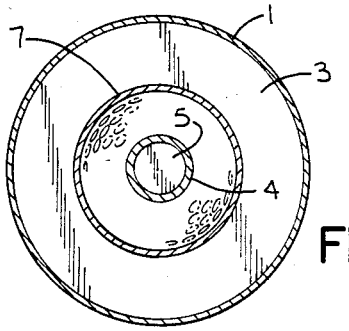
FIG. 2
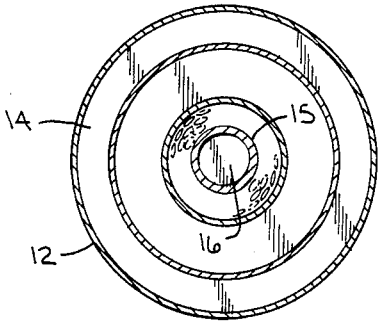
FIG. 4
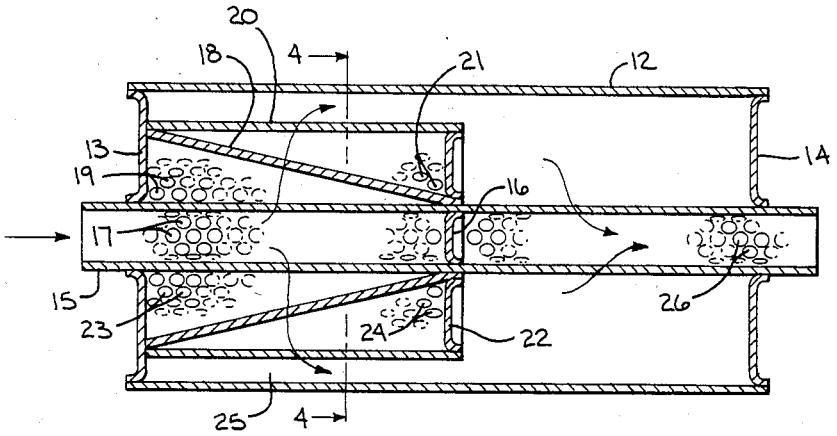
FIG. 3
FIG. 5
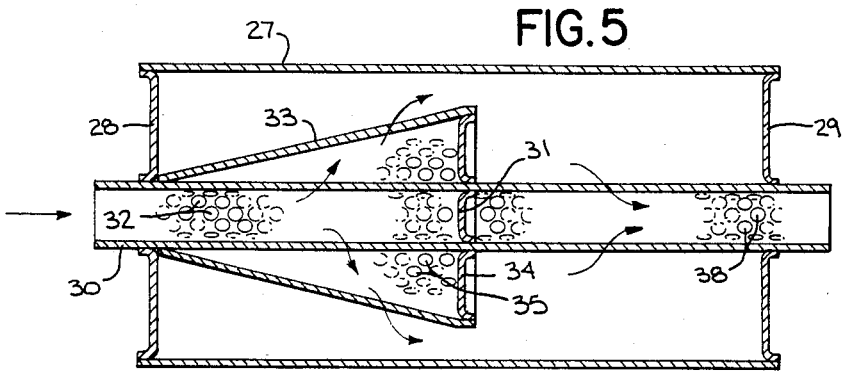

PLUG-TYPE MUFFLER SECTION

BACKGROUND OF THE INVENTION

In a typical muffler system, a portion of the sound energy delivered to the muffler is reflected back towards the source, a second portion is dissipated through a baffling arrangement in the muffler, while the remainder of the sound energy is transmitted to the atmosphere through the shell or body of the muffler and through the outlet. In any silencing system it is desired to provide maximum sound attenuation with minimum pressure restriction.

The conventional muffler comprises a series of sections or elements, such as an inlet section, an outlet section, and perhaps one or more intermediate sections. One commonly used section is what is referred to as a plug section. In a plug section, the exhaust gas enters the section through an inlet pipe and the inner end of the pipe is closed or plugged, causing the gas to flow outwardly through perforations in the inlet pipe into an outer chamber. This arrangement is known to be effective in attenuating sound energy.

More recently, various modifications of the basic plug section have been used in an attempt to increase the effectiveness of the sound energy attenuation.

SUMMARY OF THE INVENTION

The invention is directed to an improved plug section for a muffler. In accordance with the invention, the plug section includes an outer body and exhaust gas is introduced into the body through a central inlet pipe, the inner end of which is closed off or plugged.

Surrounding the inlet pipe is a generally frustoconical baffle having its small diameter end secured to the inlet tube and having its large diameter end closed off. The conical baffle provides a tapered inner chamber between the inlet pipe and the conical baffle and a second outer chamber between the conical baffle and the body.

Both the inlet pipe and the conical baffle are formed with a plurality of perforations, and the exhaust gas entering the inlet pipe is deflected outwardly by the plug through the perforations in the inlet pipe into the tapered inner chamber and then passes outwardly through the perforations in the conical baffle to the outer chamber.

The plug section, utilizing the perforated conical baffle member, provides a substantial improvement of sound attenuation, reducing both the shell noise level and the outlet noise level.

In a modified form of the invention, a perforated cylindrical baffle is positioned around the conical baffle and spaced inwardly from the body to provide a third chamber. The ends of the cylindrical baffle are closed off and the exhaust gas flowing outwardly through the perforations in the conical baffle member will then be directed through the perforations in the cylindrical baffle member to the outermost chamber between the cylindrical baffle member and the body.

Other objects and advantages will appear in the course of the following description.

DESCRIPTION OF THE DRAWINGS

The drawings illustrate the best mode presently contemplated of carrying out the invention.

In the drawings:

FIG. 1 is a longitudinal section of a muffler incorporating the improved plug section of the invention;

FIG. 2 is a section taken along line 2—2 of FIG. 1;

FIG. 3 is a longitudinal section of a modified form of the invention;

FIG. 4 is a section taken along line 4—4 of FIG. 3; and

FIG. 5 is a longitudinal section of a second modified form of the invention.

DESCRIPTION OF THE ILLUSTRATED EMBODIMENT

FIG. 1 illustrates a plug section as incorporated in a muffler or silencing system. The plug section includes a generally cylindrical outer body 1 which is enclosed at its ends by end flanges 2 and 3. An inlet pipe 4 is mounted centrally within openings in flanges 2 and 3 and serves to conduct exhaust gas to the body 1.

The central portion of pipe 4 is closed off by a plug or closure 5, while the portion of pipe 4 extending between plug 5 and flange 2 is provided with a plurality of perforations 6.

Surrounding pipe 4 is a generally frustoconical baffle 7 having a small diameter end which is secured to pipe 4 in the vicinity of plug 5, while the while the large diameter end of baffle 7 is welded, or otherwise secured, to flange 2 at a location spaced inwardly of body 1.

Conical baffle 7 in combination with inlet pipe 4 defines a generally tapered inner chamber 8, while the space between the conical baffle member 7 and body 1 defines a second outer chamber 9.

As in the case of inlet pipe 4, conical baffle 7 is provided with a plurality of perforations 10.

The exhaust gas entering through inlet pipe 4 is deflected outwardly by plug 5 through perforations 6 into the chamber 8 and then flows outwardly through perforations 10 in conical baffle 7 to outer chamber 9 and is discharged from the section through a plurality of perforations 11 in the downstream portion of pipe 4.

The use of the conical baffle 7 greatly improved the sound attenuation, providing a substantial reduction in shell noise, as well as outlet noise without significant increase in pressure restriction.

FIGS. 3 and 4 illustrate a modified form of the invention in which the plug section includes a generally cylindrical body 12, similar to body 1, which is enclosed at its ends by flanges 13 and 14. An exhaust gas inlet pipe 15 is mounted centrally within aligned openings in flanges 13 and 14 and the central portion of pipe 15 is closed off by plug 16, similar to plug 5. The portion of pipe 15 located between plug 16 and flange 13 is provided with a plurality of perforations 17.

Surrounding pipe 15 is a conical baffle 18 similar to conical baffle 7, and conical baffle 18 has a plurality of perforations 19. As shown in FIG. 3, the small diameter end of conical baffle 18 is secured to pipe 15 adjacent the position of baffle 5, while the large diameter end of member 18 is secured to flange 13.

In the embodiment shown in FIGS. 3 and 4 a generally cylindrical member 20 is positioned outwardly of conical baffle 18 and cylindrical member 20 is provided with a plurality of perforations 21. The upstream end of cylindrical member 20 is secured to flange 13, while the downstream end of member 20 is closed off by an annular baffle of flange 22.

With the use of conical baffle 18 and cylindrical member 20, three separate chambers are provided, i.e. chamber 23 between pipe 15 and conical baffle 18, intermediate chamber 24 between conical baffle 18 and cylindrical member 20 and outer chamber 25 between cylindrical member 20 and body 12.

Exhaust gas entering the section through pipe 15 will be deflected outwardly by plug 16 through the perforations 17 in pipe 15 into the chamber 23 and will then flow outwardly through perforations 19 in baffle 18 to the central chamber 24 and will then pass through the perforations 21 in cylindrical member 20 to the outer chamber. The exhaust gas can then be discharged from the section through a plurality of perforations 26 in the downstream section of pipe 15.

FIG. 5 illustrates a second modified form the invention in which the position of the conical baffle is reversed from that shown in FIGS. 1 and 2. More particularly, the muffler shown in FIG. 5 includes a generally cylindrical body 27, the ends of which are enclosed by flanges 28 and 29. An exhaust gas inlet pipe 30 is mounted within aligned openings in flanges 28 and 29 and the central portion of pipe 30 is closed off by a plug 31, similar to plug 5 of the first embodiment.

As in the case of the first embodiment, the upstream portion of inlet pipe 30 is provided with a plurality of perforations 32.

A conical baffle 33 is positioned around the pipe 30 and in this embodiment, the small diameter end of conical baffle 33 is secured to pipe 30 adjacent flange 28, while an end baffle or flange 34 encloses the large diameter end of the conical baffle 33 and connects the baffle with the pipe 30 at a location adjacent plug 31.

Conical baffle 33 is provided with a plurality of perforations 35.

The exhaust gas entering pipe 30 flows outwardly from the pipe through perforations 32 into the chamber 36 between pipe 30 and conical baffle 33 and then flows outwardly through perforations 32 in baffle 33 to the outer chamber 37 between conical baffle 33 and body 27. The exhaust gas is then discharged from the muffler section through a plurality of perforations 38 located in the downstream portion of pipe 30.

It is contemplated that the plug section of the invention can be located at the inlet or outlet of a muffler or silencing system, or located intermediate inlet and outlet sections of various configurations. In other applications, the plug section may constitute the entire silencing system. Similarly, while the exhaust gas is shown to be introduced and discharged from the muffler through the single pipe 4, it is contemplated that separate inlet and outlet pipes can be employed of various configurations.

The plug section of the invention, utilizing the perforated conical baffle member, provides a sebstantial improvement in sound attenuation, reducing both shell noise and outlet noise while maintaining an acceptable pressure restriction for the muffler or silencing system.

Various modes of carrying out the invention are contemplated as being within the scope of the following claims particularly pointing out and distinctly claiming the subject matter which is regarded as the invention.

I claim:

1. A plug section for a muffler having improved sound attenuation characteristics, comprising an outer body, an inlet pipe to introduce exhaust gas to the body and having an inner end portion disposed within the body, a closure to close off the inner end portion of said pipe, said pipe having a plurality of perforations extending substantially the entire length of said end portion, a generally conical member disposed within the body and surrounding said pipe and having a small diameter end and a large diameter end, said conical member having a plurality of second perforations extending substantially the entire length of said conical member, said conical member being spaced outwardly from said pipe to define an inner chamber therebetween and being spaced from the body to provide an outer chamber, said inner chamber being empty and constituting a sound attenuating chamber, and closure means for closing off the ends of said conical member, exhaust gas entering the section through said pipe flowing transversely outward through said first perforations into said inner chamber and then flowing transversely outward through said second perforations to said outer chamber and subsequently being discharged from said section.

2. The section of claim 1, wherein said small diameter end is secured to said pipe.

3. The section of claim 2, and including a flange connecting said pipe with said body and disposed upstream in the direction of gas flow from said closure, the large diameter end of said conical member being secured to said flange.

4. The section of claim 1, wherein said small diameter end faces upstream in the direction of gas flow.

5. A plug section for a muffler having improves sound attenuating characteristics, comprising an outer body, a cylindrical inlet pipe to introduce exhaust gas to said body and having an inner end disposed within the body, a flange connecting the inlet pipe to the outer body, plug means disposed within the inner end of said pipe to close off said inner end and spaced downstream in the direction of gas flow from said flange, the portion of said pipe disposed between said flange and said plug having a plurality of first perforations extending substantially the entire length of said portion, a conical member disposed outwardly of said pipe to provide a space therebetween and having a small diameter end secured directly to said pipe and having a large diameter end, said space being empty and constituting a sound attenuating chamber, closure means for closing off said large diameter end, said conical member having a plurality of second perforations extending substantially the entire length of said conical member, and outlet means for discharging said exhaust gas from said body, exhaust gas entering the body through said pipe flowing transversely outwardly through said first perforations into the space between said pipe and said conical member and then passing transversely outward through said second perforations into the space between said conical member and the body and then discharged through said outlet means.

6. The section of claim 5, wherein said small diameter end faces upstream in the direction of gas flow.

7. The section of claim 5, wherein said large diameter end is secured to said flange.

8. A plug section for a muffler having improved sound attenuating characteristics, comprising an outer body, an inlet pipe to introduce exhaust gas to said body and having an inner end disposed within the body, a flange connecting the inlet pipe to the outer body, plug means disposed within the inner end of said pipe to close off said inner end and spaced downstream in the direction of gas flow from said flange, the portion of said pipe disposed between said flange and said plug having a plurality of first perforations extending substantially the entire length of said portion, a conical member disposed outwardly of said pipe and having a small diameter end secured to said pipe and having a large diameter end, said conical member having a plurality of second perforations extending substantially the entire length of said conical member, closure means for closing off said large diameter end, a cylindrical member disposed outwardly around the conical member and spaced inwardly of said body, said cylindrical member having a plurality of third perforations extending substantially the entire length of said cylindrical member, second closure means for closing off the ends of said cylindrical member, the space between said pipe and said concial member defining an inner chamber, the space between said conical member and said cylindrical member defining an intermediate chamber and the space between said cylindrical member and said body defining an outermost chamber, exhaust gas entering the body through said pipe flowing outwardly through said first perforations into said inner chamber, then passing through said second perforations to said intermediate chamber and then passing through said third perforations to said outermost chamber.

9. A plug section for a muffler having improved sound attenuation characteristics, comprising an outer body, an inlet pipe to introduce exhaust gas to the body and having an inner end portion disposed within the body, a closure to close off the inner end portion of said pipe, said pipe having a plurality of perforations extending substantially the length of said end portion, a generally conical member disposed within the body and surrounding said pipe and having a small diameter end and a large diameter end, said conical member having a plurality of second perforations extending substantially the entire length of said conical member, said conical member being spaced outwardly from said pipe to define an inner chamber therebetween, a generally cylindrical member disposed concentrically outward of said conical member and spaced outwardly of said body, the space between said conical member and said cylindrical member defining an intermediate chamber and the space between said cylindrical member and said body defining an outer chamber, said cylindrical member having a plurality of third perforations, and closure means for closing off the ends of said cylindrical member, exhaust gas entering the section through said pipe flowing transversely outward through said inner perforations into said first chamber and then flowing transversely outward through said second perforations to said intermediate chamber and then flowing transversely outward through said third perforations to said outer chamber and subsequently being discharged from said section.

* * * * *